United States Patent [19]

Bulatovic

[11] Patent Number: 4,735,710

[45] Date of Patent: Apr. 5, 1988

[54] BERYLLIUM FLOTATION PROCESS

[75] Inventor: Srdjan Bulatovic, Peterborough, Canada

[73] Assignees: Falconbridge Limited, Toronto; Highwood Resources Ltd., Vancouver, both of Canada

[21] Appl. No.: 933,844

[22] Filed: Nov. 24, 1986

[30] Foreign Application Priority Data

Sep. 5, 1986 [CA] Canada ..... 517640

[51] Int. Cl.[4] ..... B03D 1/02

[52] U.S. Cl. ..... 209/166; 209/167; 252/61; 75/2; 423/155; 423/331

[58] Field of Search ..... 423/155, 331; 75/2; 209/166, 167; 252/61

[56] References Cited

U.S. PATENT DOCUMENTS

| | | | |
|---|---|---|---|
| 2,385,819 | 10/1945 | Lamb | 209/166 |
| 2,666,587 | 1/1954 | Runke | 209/166 |
| 3,078,997 | 2/1963 | Havens | 209/166 |
| 3,300,147 | 1/1967 | Johnston | 209/166 |

FOREIGN PATENT DOCUMENTS

| | | | |
|---|---|---|---|
| 1027394 | 4/1966 | United Kingdom | 209/166 |

*Primary Examiner*—S. Leon Bashore
*Assistant Examiner*—Thomas M. Lithgow
*Attorney, Agent, or Firm*—Rogers, Bereskin & Parr

[57] ABSTRACT

A process and reagents are described for separating beryllium silicate concentrates by flotation from oxidic minerals. The process is especially suitable for the separation of phenacite and bertrandite present in ores with complex gangue compositions. The ore is ground and subjected to acid pretreatment, then conditioned by the addition of pH modifier, alkali fluoride activator and a depressant containing sodium hexametaphosphate and carboxymethyl cellulose, or hexametaphosphate and quebracho. The conditioned ore is thereafter treated with a tall oil fatty acid-based collector mixture, of general formula $C_{17}H_{31-35}COOH$; which also contains cresylic acid, kerosene and a branched short-chained aliphatic alcohol, such as methyl-iso-butyl carbinol. Mercapto acetic acid and alkali metal hydrogen sulphide may also be added in the second and third stages of conditioning, respectively, for increasing selectivity. The mineral concentration process includes conventional rougher and cleaner flotation steps. Yttrium and rare earth oxides, if present will be retained in the tailings.

21 Claims, 1 Drawing Sheet

BERYLLIUM FLOTATION PROCESS

This invention relates to the mineral processing and separation of beryllium containing minerals.

Beryllium silicates are often present in oxidic silicate minerals, which may also contain yttrium and other rare earth metal oxidic compounds. More specifically, beryllium silicate such as phenacite and bertrandite are found intimately mixed with rare earth and ytrrium compounds in complex gangue oxidic ores. There are conventional mineral separation processes for floating beryllium and rare earth minerals together from silicates by the use of fatty acids, e.g. oleic acid or collectors of the sulphonate type, but the separation of beryllium silicates such as phenacite and bertrandite has so far not been satisfactorily achieved. There are no known processes which satisfactorily separate by flotation phenacite and bertrandite and similar beryllium silicates present in complex oxidic ores.

A method has now been found for separating beryllium silicates contained in oxidic mineral concentrates by flotation utilizing a tall oil fatty acid based collector mixture. The tall oil fatty acid base collector mixture is comprised of:

(a) 20 to 35% by weight cresylic acid
(b) 2 to 10% by weight branched short-chained aliphatic alcohol containing 6 carbon atoms
(c) 2 to 8% by weight of kerosene, the balance being a tall oil fatty acid having 18 carbon atoms.

BRIEF DESCRIPTION OF THE DRAWING

The preferred embodiment of the invention will now be described by reference to FIG. 1 which is a mineral separation flowsheet and to examples which illustrate the working of the preferred embodiment.

DESCRIPTION OF THE PREFERRED EMBODIMENT

Figure 1:
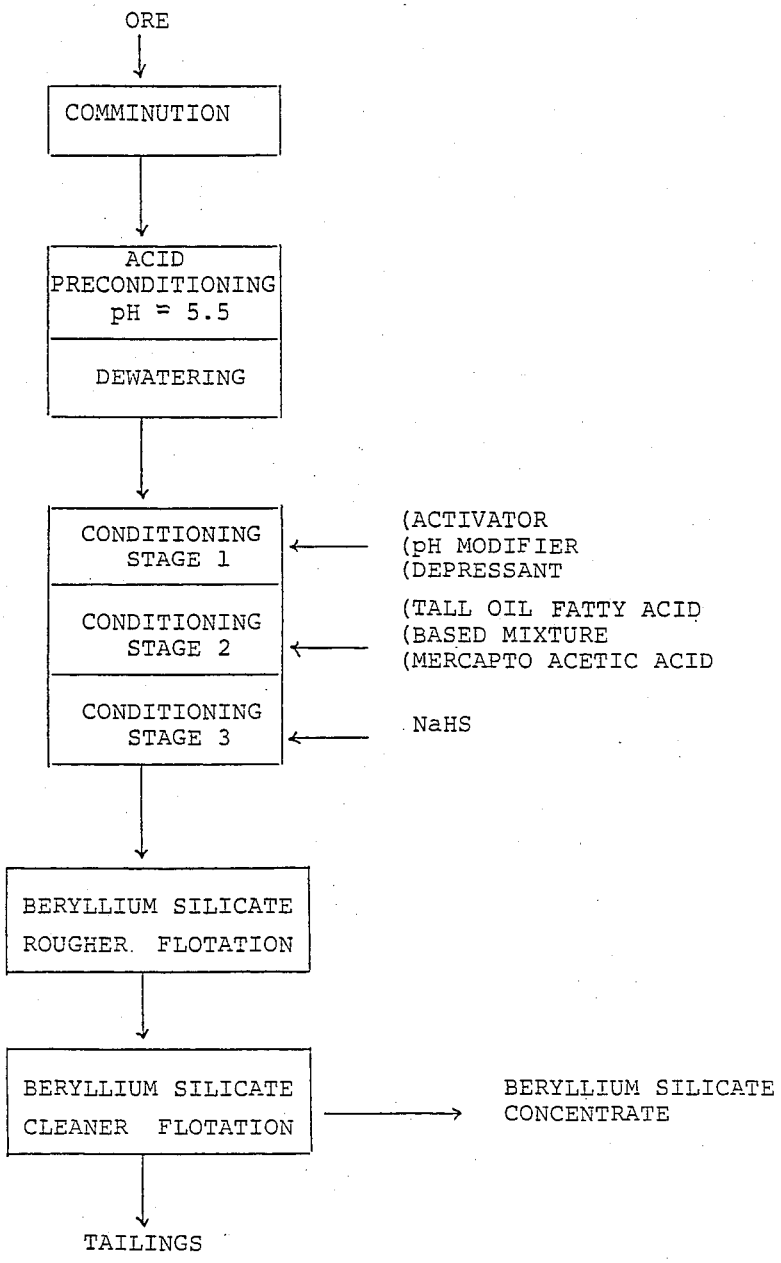

The silicate containing oxidic ore which contains phenacite or a mixture of phenacite and bertandite is ground to a suitable liberation size. For a finely disseminated ore a fineness of grind required is about 80% less than 37 μm. If there are any magnetic components present it is preferable that these be removed by magnetic separation following the grinding of the ore. The non-magnetic fraction is subsequently slurried with water, if it has not already been done during the previous mineral processing steps, and sulphuric acid is added as a pre-conditioner, with the pH adjusted to about 5 to 5.5. The pulp after the acid pre-treatment is usually thickened to around 65% solid content to remove wash water, but the exact slurry density depends mainly on convenience.

The pre-treated slurry is then conditioned by the addition of a pH modifier, activator and a depressant. The most commonly used pH modifier is sodium carbonate but other alkali carbonates may also be used to achieve a pH of 9.5. Sodium fluoride was used in this process as an activator, but other alkali fluorides or alkali silico-hexafluorides such as $Na_2SiF_6$ can also be used for conditioning.

A convenient depressant for use in the preferred embodiment of this process is a mixture of calgon glass, otherwise known as sodium hexametaphosphate, and carboxymethyl cellulose. Quebracho produces similar results in conditioning minerals as carboxymethyl cellulose and may be a preferred conditioner for the separation of some oxidic ores. Quebracho is a high tannin containing polyphenolic wood extract, usually obtained from Schinopsis trees. The preferred ratio of the sodium hexametaphosphate (calgon) to carboxymethyl cellulose (CM), or to quebracho, in the depressant mixture is 70% to 30%. In cases where the ore to be treated is high in albite or pyroxene quebracho is a preferred component of the depressant mixture, replacing carboxymethyl cellulose (CM). The conditioning stage lasts about 10 minutes with agitation, but somewhat longer periods are also acceptable. The conditioning is followed by the addition of the collector mixture of the present invention.

It is to be pointed out that the use of sodium carbonate ($Na_2CO_3$) as pH modifier, sodium fluoride (NaF) as activator and a mixture of sodium hexametaphosphate (Calgon) and carboxymethyl cellulose (CM) or quebracho as depressant, are preferred in the first stage of conditioning of the minerals, but they are by no means essential for practicing of the present invention, and other suitable pH modifiers, activators and depressants may be substituted in the flotation of beryllium silicates from oxidic minerals by the use of a tall oil fatty acid based collector mixture.

The novel collector mixture is based upon a tall oil fatty acid, essentially containing eighteen carbon atoms. The tall oil fatty compound can be described by the general formula of $C_{17}H_{31\text{-}35}COOH$, and is advantageously present in quantities around 60 wt.%. It is to be noted that fatty acid is understood to be a long-chained saturated or unsaturated aliphatic monocarboxylic acid but may be replaced by an obvious chemical equivalent. The mixture also contains 20 to 35% by weight cresylic acid, which can be broadly described as consisting of 3 cresol and 6 xylenol homologues containing higher methylated and longer chain alkyl phenols. To this mixture are added, in quantities of 2 to 10% by weight, a branched short-chained aliphatic alcohol usually not exceeding 6 carbon atoms, and kerosene.

The level of the collector mixture was found to be most beneficial when added in the ratio of 650–1200 g/ton ore. The level was found to depend on the fineness of the grind, as well as on ore composition. With finer grinding the level of collector needs to be increased. It was also found that the addition of mercapto acetic acid in the second conditioning stage will increase the selectivity of the collector mixture with respect to albite and fluorite.

The second stage of agitated conditioning, after the addition of the collector was maintained for about 10 minutes, and was followed by a third stage wherein sodium hydrogen sulphide was added to the agitated mixture.

The conditioning was followed by conventional rougher and cleaner flotation stages, which are usually part of any flotation process. Accordingly the slurry after conditioning was subjected to the froth flotation process for about 8 to 15 minutes, without further addition of reagents. The relatively low grade rougher concentrate was conventionally upgraded by cleaning in three to four stages with further additions of depressants and small quantities of collector if required.

The tailings from the various flotation steps can be combined and utilized in treatments for the recovery of other valuable minerals present in the ore, such as for example yttrium and rare earth minerals.

The depressant used in this process is known to be effective in depressing albite, mica, carbonates, fluorite and siliceous gangue. This depressant used together with the collector mixture containing tall oil fatty acids in the ratio described in this invention has been found to increase its selectivity and to also enhance the collection of beryllium silicates.

It has been found that the addition of a collector mixture, containing, a tall oil fatty acid, having the general formula of $C_{17}H_{31-35}COOH$, cresylic acid, composed of 3 cresol and 6 xylenol homologues having methylated long-chained alkyl phenols, and kerosene and branched short-chained aliphatic alcohol such as methyl-iso-butyl carbinol, in equal proportions;

to a conditioned slurry of beryllium silicate containing oxidic minerals can attain a separation of beryllium silicates that has not been achieved before.

The selectivity of the present method has been found to be assisted by the additional presence of mercapto acetic acid, which further enhances both the depression of albite and fluorite minerals, and the separation of beryllium silicates such as phenacite and bertrandite from these minerals.

Another advantage of this flotation separation method is that yttrium and rare earth minerals are simultaneously depressed and can be subsequently recovered from the tailings.

The improvement achieved in the separation of beryllium silicates contained in oxidic mineral concentrates and ores will be better understood by those skilled in the art by having regard to the examples below, which illustrate the method of the present invention in a quantitative manner.

EXAMPLE 1

Laboratory separation tests were carried out on a high grade phenacite ore, using conventional reagents including high purity oleic acid. The fineness of the grind was 95% less than 200 mesh. Sodium carbonate pH modifier and sodium fluoride with waterglass activators was used as conditioning reagents, and oleic acid with kerosene were employed as collector.

The reagents and the respective amounts per ton used, are given below as g/t:

| | |
|---|---|
| $Na_2CO_3$ = | 1800 g/t |
| NaF = | 600 g/t |
| HMP (waterglass) = | 300 g/t |
| Oleic Acid = | 1900 g/t |
| Kerosene = | 50 g/t |

The results of the flotation test are shown below:

TABLE I

| Product | Weight % | Assays, % BeO | % Distribution BeO |
|---|---|---|---|
| BeO Cl. Conc. | 4.21 | 17.46 | 66.8 |
| BeO Ro. Conc. | 11.20 | 8.80 | 89.5 |
| BeO Flot. Tail. | 88.80 | 0.13 | 10.5 |
| Head | 100.00 | 1.17 | 100.0 |

It can be seen that both recovery and concentrate grade were rather unsatisfactory.

EXAMPLE 2

Another sample of the same phenacite ore as in Example 1 but having a somewhat higher grade, was used in separation tests employing the reagent and method of the present invention.

The ore was pretreated for 5 minutes with sulphuric acid which was added at the rate of 1250 g/ton (denoted as g/t from here on), to have a slurry pH of 5.5, and subsequently dewatered to a pulp density of 65%. The obtained pulp was conditioned in a first stage for 10 minutes with agitation in the presence of the following reagents and quantities:

| | |
|---|---|
| $Na_2CO_3$ | 1500 g/t |
| NaF | 600 g/t |
| Sodium hexametaphosphate-carboxymethyl cellulose in the ratio of 70:30, hereinbelow referred to as SHCM | 300 g/t |

The tall oil fatty acid based mixture, denoted as mixtures-CS in the following examples, was made up as follows:

60% by weight tall oil fatty acid with the general formula of $C_{17}H_{31-35}COOH$, 30% by weight cresylic acid consisting of 3 cresol and 6 xylenol homologues, and containing higher methylated and longer chain alkyl phenols, 5% by weight methyl-iso-butyl carbinol, and 5% kerosene In the second stage conditioning mixture-CS was added at the rate of 1000 g/t, together with mercapto acetic acid at the rate of 100 g/t.

The pulp was agitated with these reagents for another 10 minutes forming the second stage. This was followed by a five minute third stage conditioning with sodium hydrogen sulphide (NaHS) added at the rate of 300 g/t.

The conditioning was followed by beryllium silicate rougher and cleaner flotation stages in the conventional manner. Some of the reagents already present were supplemented in the third and fourth stages of the cleaner flotation, by adding in each stage:

| | |
|---|---|
| NaF | 100 g/t |
| NaHS | 50–100 g/t |
| SHCM | 100 g/t |

The flotation results are shown in Table II.

TABLE II

| Product | Weight % | Assays, % BeO | % Distribution BeO |
|---|---|---|---|
| BeO Cl. Conc. | 6.14 | 28.6 | 89.2 |
| BeO Ro. Conc. | 16.72 | 11.1 | 94.5 |
| BeO Flot. Tail. | 83.28 | 0.12 | 5.5 |
| Feed | 100.00 | 1.95 | 100.0 |

The substantial improvement achieved by the use of the mixture of the present invention is clearly demonstrated, and is shown by the high BeO content of the separated concentrate obtained in the cleaner flotation stage, amounting to a relatively small portion of the ore treated. This represents a high rate of recovery. Only a small fraction of the beryllium present in the ore was discarded in the tailing.

EXAMPLE 3

Laboratory tests were carried out with reagents and conditions similar to those used in Example 1 for the separation of beryllium silicates in a mixed phenacite ore. This ore also contained yttrium and rare earth oxides, which required a subsequent flotation of the separated beryllium and yttrium bearing tailing.

Reagents used:

| | | |
|---|---|---|
| $H_2SO_4$ | 1500 g/t | in the acid pretreatment step. |
| $Na_2CO_3$ | 1600 g/t | in the grinding step. |
| NaF | 600 g/t | in conditioning stage 1. |
| HMP (water glass) | 500 g/t | |
| Oleic Acid | 1900 g/t | in the second conditioning stage. |
| Kerosene | 55 g/t | |

The results are summarized in Table III.

TABLE III

| Product | Weight % | Assays, % BeO | % Distribution BeO |
|---|---|---|---|
| BeO Cl. Conc. | 7.42 | 8.60 | 73.7 |
| BeO Ro. Conc. | 8.95 | 7.74 | 80.0 |
| BeO Flot. Tail. | 91.05 | 0.20 | 20.0 |
| Head | 100.00 | 0.87 | 100.0 |

As shown the beryllium separation by this conventional process is rather mediocre. In addition, subsequent process steps are required for the separation of beryllium minerals from the yttrium minerals also present in the concentrate.

EXAMPLE 4

The mixed phenacite ore used in the separation of Example 3 was treated by the reagents and method of the present invention, using the sequence of reagent addition and duration of stages as described in Example 2.

Reagents used and their rate of addition:

| | | |
|---|---|---|
| $H_2SO_4$ | 1250 g/t | in acid pretreatment step. |
| $Na_2CO_3$ | 1500 g/t | in the first stage of conditioning. |
| NaF | 300 g/t | |
| SHCM | 300 g/t | |
| Mixture CS | 800 g/t | in the second stage of conditioning. |
| Mercapto Acetic Acid | 100 g/t | |
| NaHS | 300 g/t | in the third stage of conditioning. |

The results are shown in Table IV.

TABLE IV

| Product | Weight % | Assays, % BeO | % Distribution BeO |
|---|---|---|---|
| BeO Cl. Conc. | 2.68 | 27.5 | 80.0 |
| BeO Ro. Conc. | 6.61 | 12.57 | 90.0 |
| BeO Flot. Tail. | 93.39 | 0.099 | 10.0 |
| Feed | 100.00 | 0.93 | 100.0 |

Comparison of results of Examples 1, 2, 3 and 4 shows clearly the effectiveness of the new process on both concentrate grades and recoveries. Both the depressant combinations and the collector mixtures are responsible for the significant improvement in the separation of beryllium minerals over those in which conventional depressants and fatty acid collectors were used. It should also be pointed out that further improvement could be achieved in the recoveries of Example 4 by increasing the level of Mixture CS addition to 1000 g/t, as was done in Example 2.

EXAMPLE 5

In order to compare the efficacy of the collector mixture of the present invention, a flotation test was conducted on the same ore as in Example 4, under the same mineral processing conditions and with reagent additions identical to those in Example 4, but with a conventional collector replacing the collector mixture CS. Thus the reagents were the following:

| | | |
|---|---|---|
| $H_2SO_4$ | 1250 g/t | in the acid conditioning step |
| $Na_2CO_3$ | 1500 g/t | in first stage conditioning |
| NaF | 600 g/t | |
| SHCM (70:30) | 300 g/t | |
| Fatty Acid | 800 g/t | in second stage conditioning |
| Mercapto Acetic Acid | 100 g/t | |
| NaHS | 300 g/t | in third stage conditioning |

The results are shown in Table V.

TABLE V

| Product | Weight % | Assays, % BeO | % Distribution BeO |
|---|---|---|---|
| BeO Cl. Conc. | 3.97 | 17.1 | 76.6 |
| BeO Ro. Conc. | 11.85 | 6.61 | 88.5 |
| BeO Flot. Tail. | 88.15 | 0.11 | 11.5 |
| Feed | 100.00 | 0.88 | 100.0 |

By comparing the results from Examples 4 & 5, it can be seen that the new collector mixture is highly selective with respect to beryllium compounds contained in complex gangue minerals.

EXAMPLES 6–9

In these examples flotation tests were conducted on the same mixed phenacite ore, and under mineral processing conditions similar to those of examples 2 & 4. The composition of the collector mixture was varied however, as is indicated in the following Table VI. In all the following examples, $H_2SO_4$ was added at 1250 g/t in the acid pretreatment; In the first stage of conditioning the following reagents were added:

| | |
|---|---|
| $Na_2CO_3$ | 1800 g/t |
| NaF | 600 g/t |
| SHCM | 450 g/t; |
| NaHS | 300 g/t in the third stage conditioning |

Table VI summarizes the variations in the composition of the collector mixture added in the second stage of conditioning. All the collector mixtures tested contained 60 wt.% tall oil fatty acid, having the general formula of $C_{17}H_{31-35}COOH$.

It can thus be seen, some variations in the collector mixture composition will also provide some degree of beryllium silicate separation as is shown in Tests 7 & 8. The collector mixture with cresylic acid containing non-methylated and short-chained alkyl phenols provides acceptable separation as well, but for best results in both beryllium silicate flotation and in the depression of ytrrium values, the reagent mixtures and composition as defined in this invention have been found most satisfactory, as shown in Test 6.

TABLE VI

| Test No. | Additional Reagents in Mixture CS at 850 g/t. | Product | Weight % | Assays, % BeO | Assays, % $Y_2O_3$ | % Distribution BeO | % Distribution $Y_2O_3$ |
|---|---|---|---|---|---|---|---|
| 6 | 30% cresylic acid containing | BeO Cl. Conc. | 2.68 | 27.5 | 0.21 | 79.6 | 1.6 |
| | 3 cresol and 6 xylenol | BeO Ro. Conc. | 6.61 | 12.57 | 0.52 | 89.8 | 10.1 |
| | homologues | BeO Ro. Tail. | 93.15 | 0.099 | 0.33 | 10.1 | 89.8 |
| | 5% MIBC | Flot. Feed (Calc.) | 99.76 | 0.93 | 0.34 | 99.9 | 99.9 |
| | 5% Kerosene | | | | | | |
| 7 | 20% cresylic acid containing | BeO Cl. Conc. | 2.75 | 21.1 | 0.24 | 65.1 | 1.9 |
| | 3 cresol and 6 xylenol | BeO Ro. Conc. | 15.17 | 5.27 | 0.64 | 89.3 | 28.2 |
| | homologues | BeO Ro. Tail. | 84.44 | 0.11 | 0.29 | 10.5 | 71.5 |
| | 10% Kerosene | Flot. Feed (Calc.) | 99.61 | 0.89 | 0.34 | 99.8 | 99.7 |
| | 10% Dehydroabiethylamine | | | | | | |
| 8 | 20% cresylic acid containing | BeO Cl. Conc. | 2.24 | 27.3 | 0.14 | 65.4 | 0.9 |
| | 3 cresol and 6 xylenol | BeO Ro. Conc. | 10.75 | 7.52 | 0.51 | 86.5 | 15.6 |
| | homologues | BeO Ro. Tail. | 88.86 | 0.14 | 0.33 | 13.3 | 84.1 |
| | 10% Kerosene | Flot. Feed (Calc.) | 99.61 | 0.93 | 0.35 | 99.8 | 99.7 |
| | 10% Mercapto acetic acid | | | | | | |
| 9 | 30% cresylic acid containing | BeO Cl. Conc. | 2.31 | 27.6 | 0.13 | 73.3 | 0.8 |
| | non-methylated and short- | BeO Ro. Conc. | 4.38 | 17.5 | 0.38 | 87.7 | 4.6 |
| | chained alkyl phenols | BeO Flot. Tail. | 94.56 | 0.11 | 0.36 | 12.1 | 95.0 |
| | 5% MIBC | Feed (Calc.) | 98.89 | 0.87 | 0.36 | 99.8 | 99.6 |
| | 5% Kerosene | | | | | | |

EXAMPLE 10

This example describes flotation tests conducted on a high albite and significant yttrium minerals containing mixed phenacite ore.

The reagents added and collector mixture-CS, as well as the manner of addition, were similar to those in previous examples, except that quebracho was substituted for carboxymethyl cellulose in the depressant mixture. Quebracho, as has been briefly described hereinabove, is a high tannin polyphenolic wood extract obtained mainly from Schinopsis trees.

The ore was ground and the magnetic fraction removed.

Reagents added:

| | | |
|---|---|---|
| $H_2SO_4$ | in acid pretreatment | 1250 g/t |
| $Na_2CO_3$ | pH modifier | 1500 g/t |
| NaF | activator | 300 g/t |
| Sodium hexametaphosphate | | |
| quebracho | in the ratio of 70:30 by weight | |
| (SHQO) | in 1st conditioning stage | 300 g/t |
| Mixture CS | in 2nd stage conditioning | 750 g/t |
| Mercapto Acetic Acid in 2nd stage conditioning | | 100 g/t |
| NaHS | in 3rd stage conditioning | 300 g/t |

The beryllium flotation tailings were subsequently subjected to flotation separation for yttrium recovery.

The results of these flotation tests are shown in Table VII.

TABLE VII

| Test No. | Depressant Used | Product | Wt. % | % Distribution BeO | % Distribution $Y_2O_3$ | % Distribution BeO | % Distribution $Y_2O_3$ |
|---|---|---|---|---|---|---|---|
| 10 | SHQO | BeO Cl. Conc. | 2.93 | 25.9 | 0.094 | 83.0 | 0.8 |
| | | $Y_2O_3$ Cl. Conc. | 11.13 | 0.98 | 2.19 | 10.5 | 74.6 |
| | | $Y_2O_3$ Flot. Tail | 84.94 | 0.065 | 0.093 | 6.2 | 24.2 |
| | | Magnetics | 1.00 | 0.26 | 0.12 | 0.3 | 0.4 |
| | | Head (Calc) | 100.00 | 0.90 | 0.33 | 100.0 | 100.0 |

It can thus be seen that improvements in grade of beryllium concentrate and recovery of yttrium into the beryllium flotation tailings and subsequent recovery into a yttrium concentrate, are possible with high albite ore using quebracho.

The froth flotation of the present invention can be performed by applying conventional flotation practices and unusual techniques are not required. In general, any mechanical flotation machine or flotation cell may be employed, or air cells may be used.

I claim:

1. A method for separating beryllium silicates contained in oxidic mineral concentrates which comprises, forming an agitated aqueous slurry of an oxidic mineral concentrate then adding thereto a tall oil fatty acid based mixture comprising:

(a) 20 to 35% by weight cresylic acid (b) 2 to 10% by weight branched short-chained aliphatic alcohol containing 6 carbon atoms (c) 2 to 8% by weight of kerosene, the balance being a tall oil fatty acid having 18 carbon atoms; and separating beryllium silicates by froth flotation.

2. A method of separating beryllium silicates as recited in claim 1 wherein an oxidic mineral concentrate slurry is conditioned by a treatment with pH modifier, activator and depressant prior to the addition of said tall oil fatty acid based mixture.

3. A method according to claim 1 wherein said tall oil fatty acid based mixture contains 30% by weight cresylic acid.

4. A method according to claim 3 wherein said cresylic acid contains 3 cresol and 6 xylenol homologues bonded with higher methylated and longer chained alkyl phenols.

5. A method according to claim 1 wherein said tall oil fatty acid based mixture contains branched short-chained aliphatic alcohol and kerosene in equal proportions by weight.

6. A method according to claim 1, 2 or 5, wherein said branched short-chained aliphatic alcohol containing 6 carbon atoms is methyl-iso-butyl carbinol.

7. A method as recited in claim 2 wherein said conditioning activator is selected from the group consisting of sodium fluoride, potassium fluoride, sodium silicohexafluoride and potassium silicohexafluoride.

8. A method as recited in claim 2 wherein said conditioning depressant is a mixture of sodium hexametaphosphate and one of the group consisting of carboxymethyl cellulose and quebracho.

9. A method as recited in claim 2 wherein mercapto acetic acid is added to the conditioned oxidic mineral slurry together with said tall oil fatty acid based mixture for flotation of beryllium silicates.

10. A method as recited in claim 1 wherein said beryllium silicate flotation step is followed by beryllium cleaner flotation steps in the additional presence of an alkali metal hydrogen sulphide.

11. A method as recited in claim 1 wherein the oxidic mineral concentrate slurry is preconditioned with sulphuric acid.

12. A method as recited in claim 11 wherein said oxidic minerals have been ground and magnetic components are removed from said oxidic minerals prior to said preconditioning step.

13. A method according to claim 1, or 9 wherein substantially all yttrium containing minerals present in the oxidic minerals are depressed and retained in the slurry separated from beryllium silicates by said froth flotation step.

14. A method as recited in claim 1, 2 or 8 wherein said beryllium silicate is at least one of the group consisting of phenacite and bertrandite.

15. Method for separating beryllium silicates contained in oxidic mineral concentrates which comprises, forming an agitated aqueous slurry of an oxidic mineral concentrate and conditioning said slurry by a treatment with a pH modifier, an activator selected from the group consisting of sodium fluoride, potassium fluoride, sodium silicohexafluoride and potassium silicohexafluoride, and a depressant comprised of sodium hexametaphosphate and one of the group consisting of carboxymehtyl cellulose and quebracho; adding to said conditioned slurry a tall oil fatty acid based collector mixture of:

(a) 30% by weight cresylic acid (b) 2 to 10% by weight branched short-chained aliphatic alcohol containing 6 carbon atoms (c) 2 to 8% by weight of kerosene, said short-chained aliphatic alcohol and said kerosene being present in equal proportions, the balance of said mixture being a tall oil fatty acid having 18 carbon atoms; and separating beryllium silicates by froth flotation.

16. A method as recited in claim 15 wherein said cresylic acid in said tall oil fatty acid based mixture contains 3 cresol and 6 xylenol homologues bonded with higher methylated and longer chained alkyl phenols.

17. A method as recited in claim 15 wherein mercapto acetic acid is added to the conditioned oxidic mineral slurry together with said tall oil fatty acid based mixture for flotation of beryllium silicates.

18. A method as recited in claim 15 wherein said beryllium silicate flotation step is followed by beryllium cleaner flotation steps in the additional presence of an alkali metal hydrogen sulphide.

19. A method as recited in claim 15 wherein the oxidic mineral concentrate slurry is preconditioned with sulphuric acid.

20. A method according to claim 15, 16 or 17 wherein substantially all yttrium containing minerals present in the oxidic mineral concentrate are depressed and retained in the slurry separated from beryllium silicates by said froth flotation steps.

21. A method according to claim 15, 16 or 17 wherein said beryllium silicate is at least one of the group consisting of phenacite and bertrandite.

* * * * *